US005387132A

United States Patent [19]

Sarver et al.

[11] Patent Number: 5,387,132

[45] Date of Patent: Feb. 7, 1995

[54] KEYED CARD EDGE CONNECTOR

[75] Inventors: Douglas R. Sarver, Millerstown; Mark R. Thumma, Oberlin; David P. Wike, Hummelstown, all of Pa.

[73] Assignee: The Whitaker Corporation, Wilmington, Del.

[21] Appl. No.: 149,690

[22] Filed: Nov. 9, 1993

[51] Int. Cl.[6] ..... H01R 9/09

[52] U.S. Cl. ..... 439/633; 439/681

[58] Field of Search ..... 439/633, 680, 681

[56] References Cited

U.S. PATENT DOCUMENTS

| | | | |
|---|---|---|---|
| 3,576,519 | 4/1971 | Jayne et al. | 339/186 |
| 3,634,816 | 1/1972 | Zell | 339/186 M |
| 3,673,548 | 6/1972 | Mattingly, Jr. et al. | 339/186 M |
| 3,675,186 | 7/1972 | Jayne et al. | 339/186 M |
| 3,818,280 | 6/1974 | Smith et al. | 317/101 DH |
| 4,241,381 | 12/1980 | Cobaugh et al. | 361/413 |
| 4,354,724 | 10/1982 | Jarmy | 339/186 R |
| 4,478,469 | 10/1984 | Waite et al. | 339/17 LC |
| 4,614,391 | 9/1986 | Baader | 339/91 R |
| 4,715,820 | 12/1987 | Andrews, Jr. et al. | 439/59 |
| 4,726,791 | 2/1988 | Rudy, Jr. et al. | 439/677 |
| 4,772,227 | 9/1988 | Pelzl et al. | 439/681 |
| 4,822,305 | 4/1989 | Waters | 439/681 |
| 4,869,672 | 9/1989 | Andrews, Jr. | 439/60 |
| 4,993,972 | 2/1991 | Lin | 439/637 |
| 5,041,025 | 8/1991 | Haitmanek | 439/681 |
| 5,052,936 | 10/1991 | Biechler et al. | 439/60 |
| 5,173,063 | 12/1992 | Barkus et al. | 439/681 |
| 5,277,591 | 1/1994 | Felcman et al. | 439/633 |

FOREIGN PATENT DOCUMENTS

| | | | |
|---|---|---|---|
| 379176 | 7/1990 | European Pat. Off. | 439/630 |

*Primary Examiner*—Daniel W. Howell

[57] ABSTRACT

A card edge connector (10) for connection to a circuit board (11). At least one key position (19, 20) is formed in the connector (10) between the contacts (15) and the end walls (13, 14) of the connector housing (12). At least one key (21) is disposed in the at least one key position (19, 20). At least one key slot (22) is formed in the circuit board (11) to cooperate with and receive the key (21). A removable key (21) may be removed from the key opening (19, 20) with a tool (27). In an alternate embodiment, the key (21') is irremovable.

7 Claims, 8 Drawing Sheets

KEYED CARD EDGE CONNECTOR

FIELD OF THE INVENTION

The present invention relates to a card edge connector and more particularly to the card edge connector having keys for connection to a circuit board.

BACKGROUND ART

Card edge connectors can receive circuit boards having contacts which are aligned with cooperating contacts in the connectors. The applicant is aware of the following U.S. patents in which a keying means is disclosed to assure alignment of the members and to permit connection of preselected members.

| U.S. Pat. No. | Inventor(s) |
|---|---|
| 3,634,816 | Zell |
| 3,818,280 | Smith et al. |
| 4,715,820 | Andrews, Jr. et al. |
| 4,869,672 | Andrews, Jr. |
| 4,993,972 | Lin |
| 5,173,063 | Barkus et al. |

The prior art recognizes the need to key the connectors to the circuit boards to align the contacts and to facilitate accurate assembly of electrical interconnection systems. In all of the known connectors, the keying interrupts the pattern of the contacts on the connector and reduces the total number of contacts which would be available if the keying means were not a part of the connector. Also, the connectors are specific for the circuit board and do not permit the connector to be used with circuit boards having differing dimensions. U.S. Pat. No. 4,993,972 issued to Lin, addresses the need to provide a connector adapted to receive a variety of different width plug-in panels to increase the versatility and usefulness of the connector, and discloses special spacer blocks to effect this versatility.

However, there exists a need for a connector/circuit board system which permits the simple alignment of the connector and the circuit board without reducing the number of contacts and which is sufficiently versatile to allow a simple connector to be used with a variety of circuit boards.

SUMMARY OF THE INVENTION

The present invention provides a connector which is keyed to a circuit board. In one embodiment the key is removable and in another embodiment the key is irremovable. The disposition of the key permits alignment of the connector and the circuit board and does not reduce the number of contacts. The keying permits the connector to be used with a variety of configurations of circuit boards.

In accordance with the teachings of the present invention, there is disclosed a card edge connector for connecting to a circuit board. The connector includes a housing having a first end wall and an opposite second end wall, and a row of separated contacts having an initial contact and a terminal contact. The initial contact is spaced from the first end wall, and the terminal contact is spaced from the second end wall. A longitudinal slot is formed in the housing. A first key opening is formed in the housing between the first end wall and the initial contact. A second key opening is formed in the housing between the second end wall and the terminal contact. At least one key is disposed in at least one of the key openings in the housing. The circuit board is disposed perpendicularly to the connector and is removably received in the longitudinal slot in the housing. The circuit board has at least one key slot formed therein, wherein when the circuit board is received in the connector, the at least one key in the connector cooperates with and is received in the at least one key slot in the circuit board.

In one preferred embodiment, the at least one key is removable, being insertable in and removable from, the at least one key opening to permit connection with different circuit boards. An access slot is formed on the housing adjacent to the key opening, wherein a tool may be inserted into the access slot permitting removal of the key.

In another preferred embodiment, the at least one key is irremovably formed in the at least one key opening in the housing.

In yet another preferred embodiment, a first key is disposed in the first key opening and a second key is disposed in the second key opening. The circuit board has two key slots, wherein when the circuit board is received in the connector, both keys cooperate with and are received in the respective key slots in the circuit board.

These and other objects of the present invention will become apparent from a reading of the following specification, taken in conjunction with the enclosed drawings.

DESCRIPTION OF THE PREFERRED EMBODIMENTS

Figure 1:
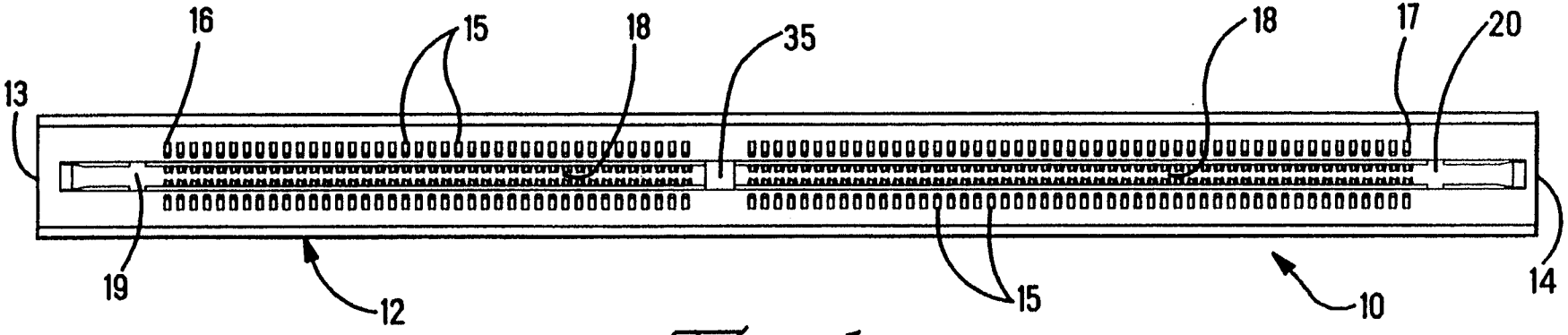
FIG. 1 is a top plan view of the connector of the present invention showing the key openings at opposite ends of the connector.

With reference to FIGS. 1–4 there is shown a connector 10 and a circuit board 11. The connector 10 has a housing 12 which has a first end wall 13 and an opposite second end wall 14. Between the end walls 13, 14, there is a row of separated contacts 15 which are divided into two groups disposed on either side of an alignment post 35 formed in the connector 10. One group has a greater number of contacts than the other group so that the alignment post 35 is disposed away from the mid-point of the connector. Thus, there is one major alignment device and the connectors are not interrupted. An initial contact 16 is the first contact of the row 15 and is spaced from the first end wall 13. A terminal contact 17 is the last contact of the row and is spaced from the second end wall 14. A longitudinal slot 18 is formed in the housing 12. The longitudinal slot extends at least from the initial contact 16 to the terminal contact 17. A first key position 19 is formed in the housing 12 between the initial contact 16 and the first end wall 13. A second key position 20 is formed in the housing 12 between the terminal contact 17 and the second end wall 14. If desired, only one key position 19 or 20 may be formed in the housing 12. A key 21 is disposed in at least one of the key positions 19, 20 or two keys 21 may be disposed in the two key openings 19, 20 as will be described.

The circuit board 11 is disposed perpendicularly to the connector 10 such that the circuit board 11 is removably received in the longitudinal slot 18 in the connector 10. The circuit board 11 has at least one key slot 22 formed therein. The key slot 22 is disposed near the end of the circuit board 11, and two key slots 22, if present, may be disposed near opposite ends of the circuit board 11. The key slots 22 are so disposed that the key 21 (or keys) in the connector 10 cooperate with and are received in the key slots 22 in the circuit board 11. The circuit board 11 has an alignment slot 36 which is disposed away from the mid-point of the circuit board 11. The alignment 36 cooperates with and receives the alignment post 35 when the circuit board 11 is joined to the connector 10. The off-center positioning of the alignment slot 36/alignment post 35 assures unidirectional disposition of the circuit board 11 with respect to the connector 10. The circuit board 11 further has a first end wall slot 37 and a second end wall slot 38 formed thereon. When the circuit board 11 is joined to the connector 10, the first end wall 13 is received in the first end wall slot 37 and the second end wall 14 is received in the second end wall slot 38. These respective walls and slots further assure proper alignment of the circuit board 11 and the connector 10. The circuit board 11 has contacts 23 and when the circuit board 11 is mated with the connector 10, the contacts 23 of the circuit board 11 engage the contacts 15 of the connector to complete an electrical circuit. The contacts 15 have a resiliency and the circuit board 11 is retained together with the connector 10 due to the resulting frictional forces between the contacts 23, 15.

Figures 9A, 9B, 9C:
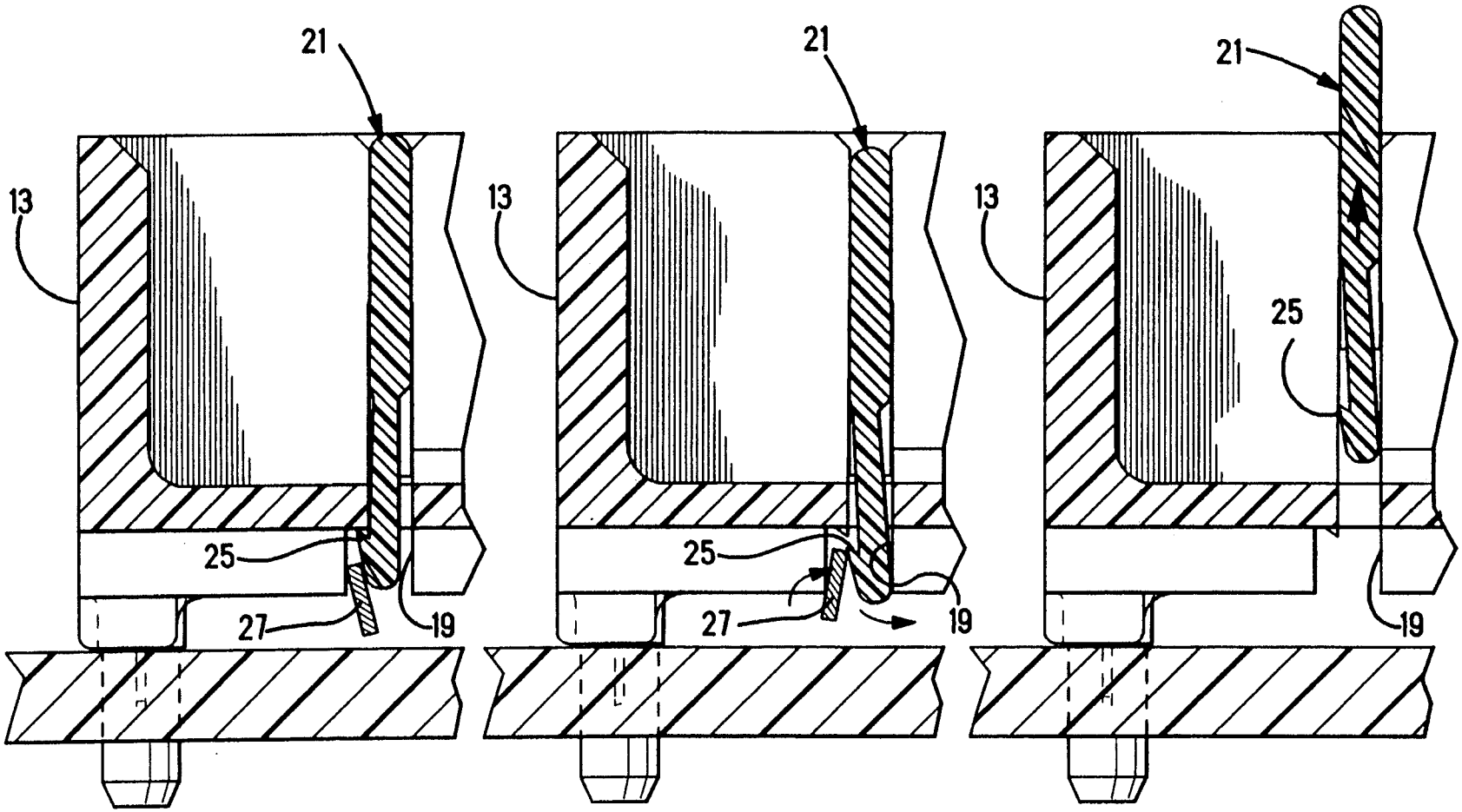
FIG. 9A–9C are cross section views showing a tool releasing the latch on the removable key to permit removal of the key from the connector.

Referring now to FIGS. 5–8, in a preferred embodiment, the key 21 is removable. The key 21 has latching means 25 formed thereon to engage the connector housing 12 when the key 21 has been disposed in the respective key position 19, 20. The latching means 25 may be a hook, a step, a protrusion, a circular band or other means which permit the key 21 to be inserted in the key position 19, 20 and for the key 21 to be held therein in a releasable manner. In order to facilitate removal of the key 21, an access slot 26 may be formed in the housing 12 adjacent to the respective key position 19, 20. A tool 27 may be inserted in the access slot to disengage the latching means 25 and permit removal of the key 21 (FIGS. 9A–9C)

The removable key 21 may be disposed in the first key position 19, in the second key opening 20 or in both key positions 19, 20. In any of the selected dispositions, the circuit board 11 has cooperating key slots 22 formed therein. Thus, three (3) different configurations of circuit boards 11 may be mated to the single connector 10 by simple use of the removable key 21 such that the present invention is provided with a versatility not achievable by the prior art. Even if no key is disposed in the connector 10, any of the circuit boards can be received by the connector 10 and may be considered a fourth possible configuration. The present invention allows the user to configure the connector 10 to accept a specific type of circuit board 11 as, for example, a central process unit or a memory board.

Figure 3:
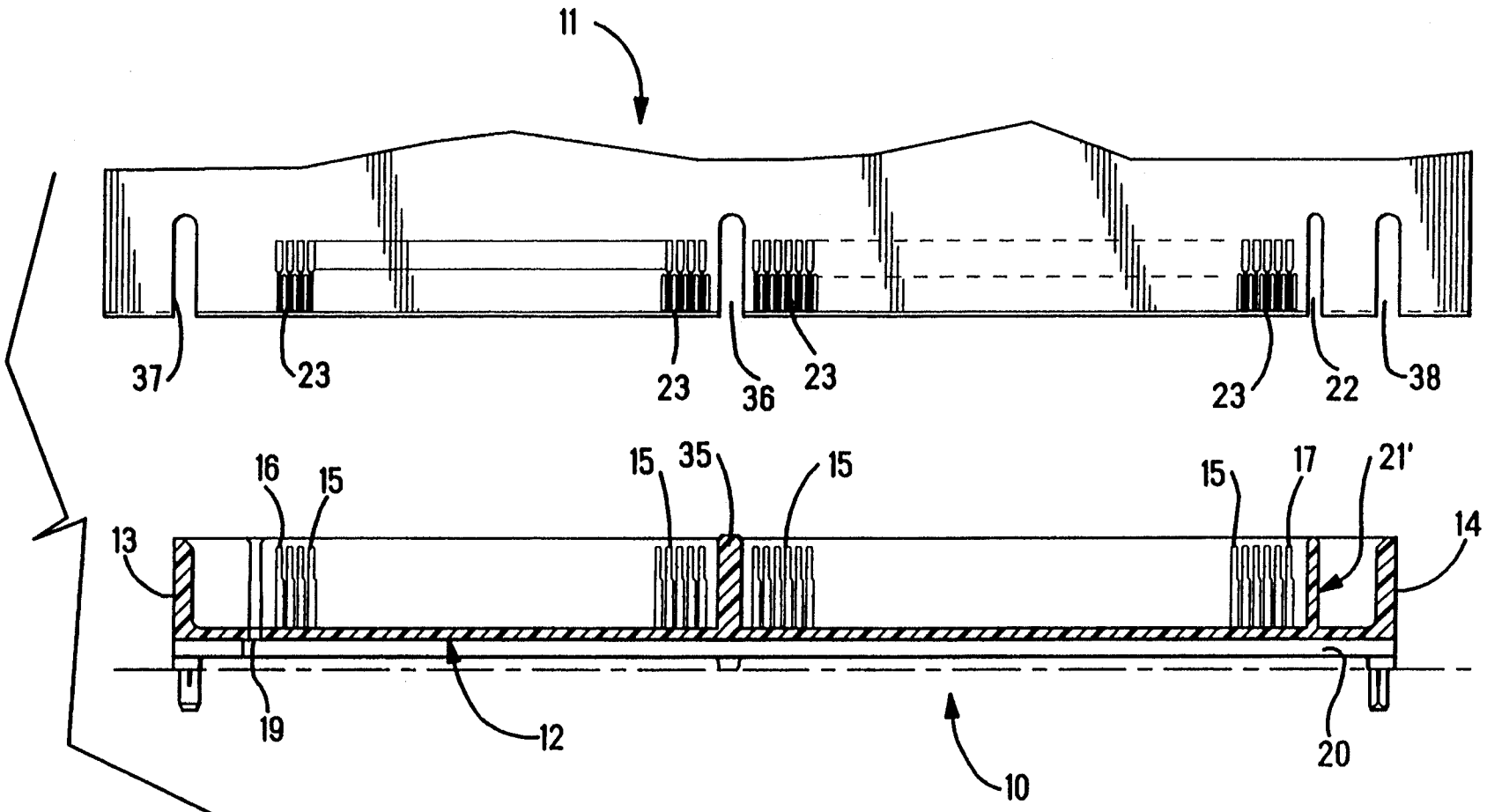
FIG. 3 is an exploded view of the present invention showing the connector in cross section and the circuit board and further showing one nonremovable key to connect the connector to the circuit board.
Figure 4:
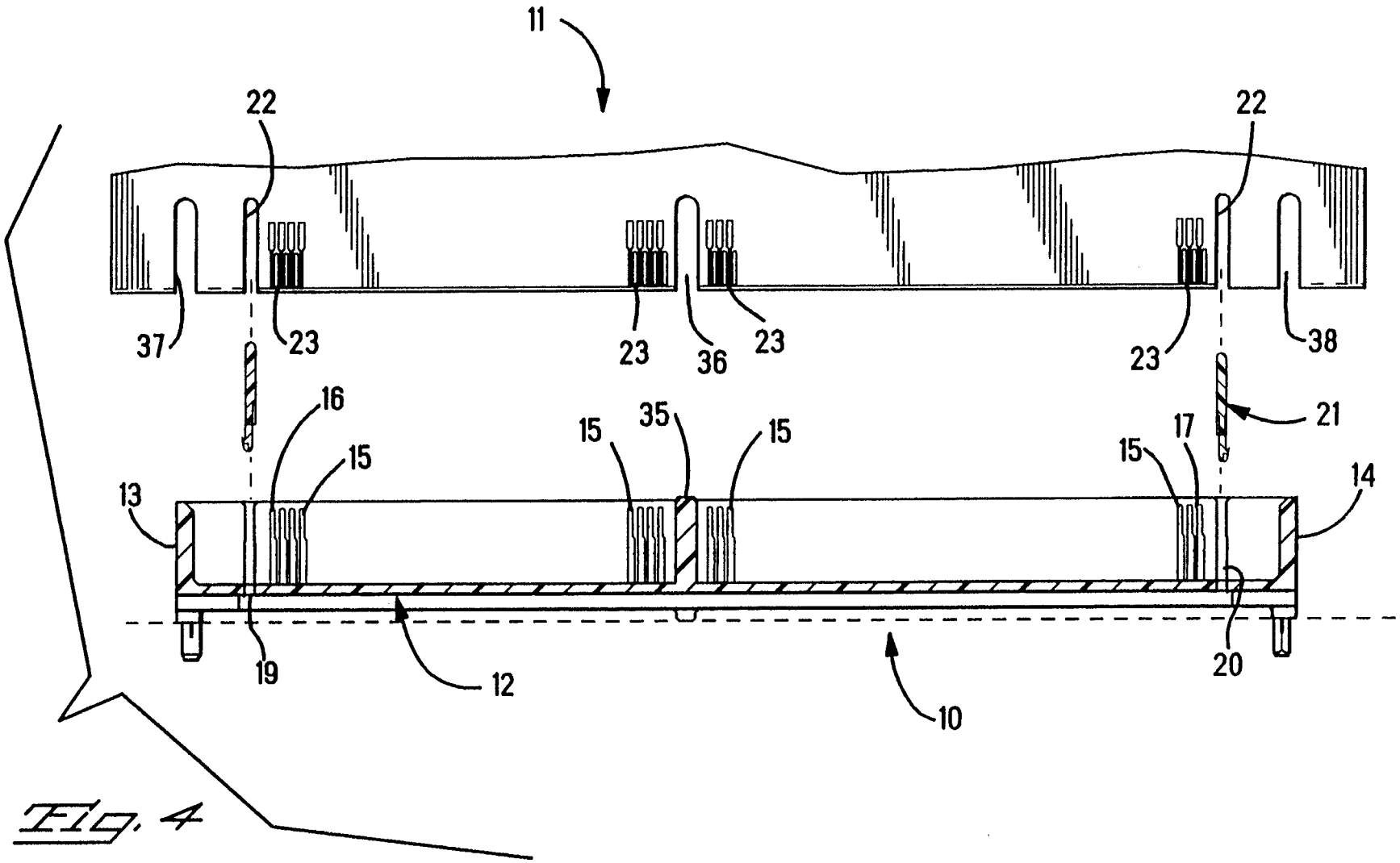
FIG. 4 is an exploded view of the present invention showing the connector in cross section and the circuit board and further showing two removable keys to connect the connector to the circuit board.

In an alternate embodiment, as shown in FIG. 3, the key 21' is irremovably formed in the connector housing 12 in the respective key position 20. In this embodiment, key 21' is an integral wall within the housing 12. Alternatively a separate non-removable member may also be used. In a manner similar to the removable key 21, the irremovable key 21' may be molded in the first key position 19, the second key position 20 or in both key positions 19, 20. The connector 10 of the alternate embodiment may mate to any one of three (3) configurations of circuit boards 11 which have the respective cooperating key slots 22 to receive the key 21' in the first key position 19, the second key position 20 or both key positions 19, and 20. FIG. 3 shows the key 21' irremovably formed in one key position in the housing 12. The other dispositions of the irremovable key 21' are not shown. In this manner, the connector 10 with the irremovable key 21' also has the versatility for the user to select a specific type of circuit board 11 to mate with the connector 10.

Figure 10:
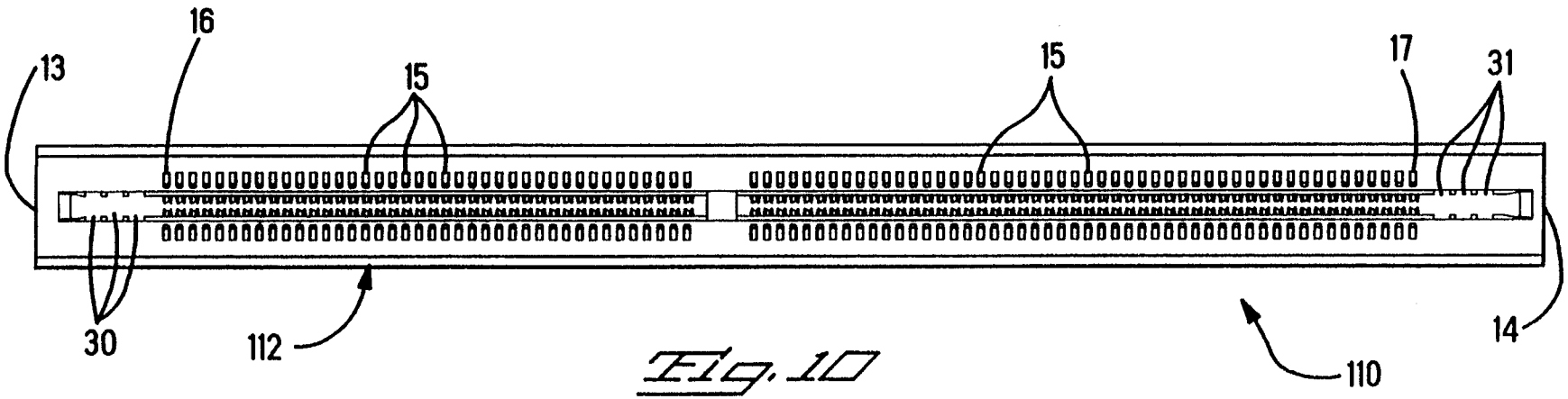
FIG. 10 is a top plan view of the connector of the present invention showing a plurality of key openings near opposite ends of the connector such that different circuit boards may be received by the connector.
Figure 2:
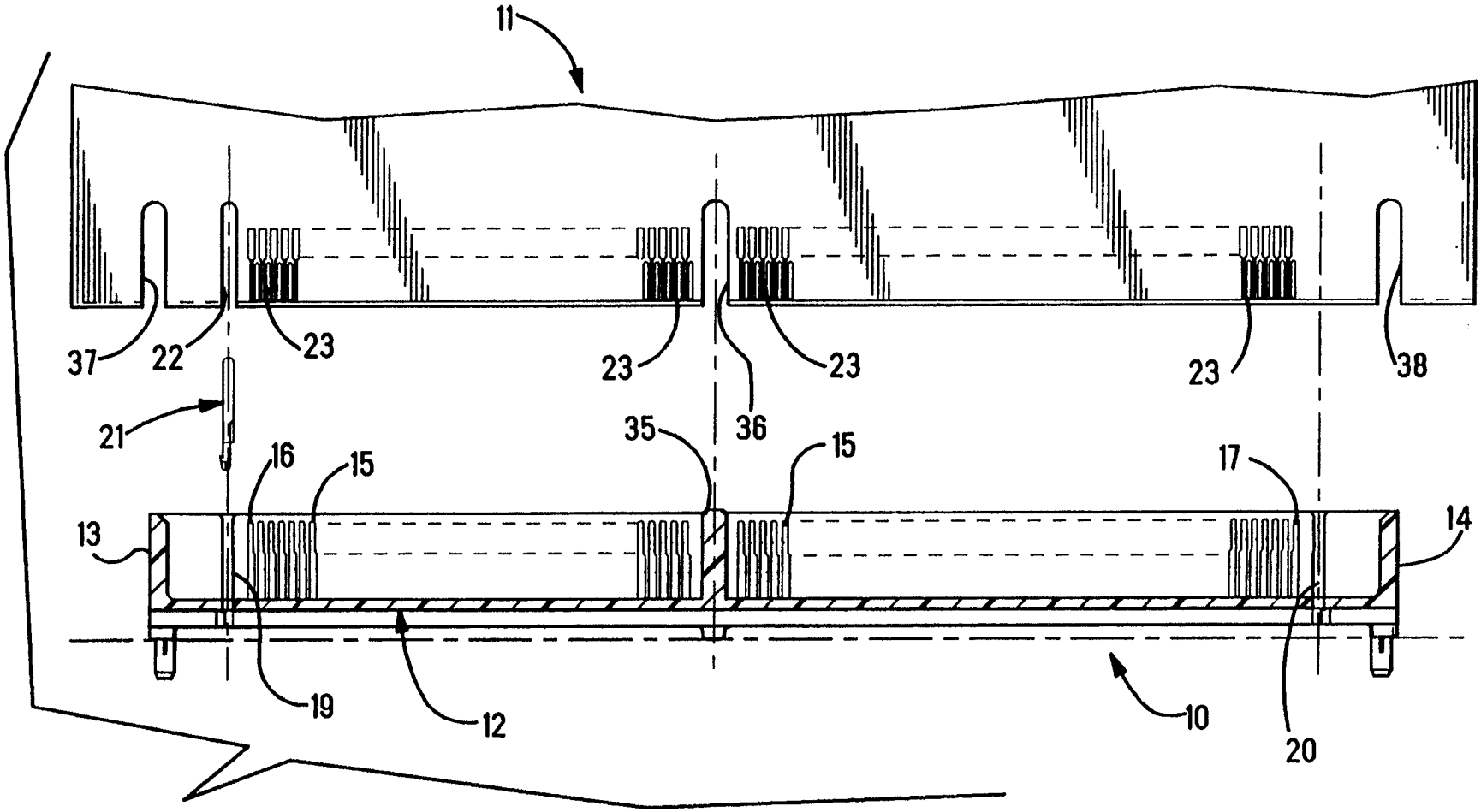
FIG. 2 is an exploded view of the present invention showing the connector in cross section and the circuit board and further showing one removable key to connect the connector to the circuit board.
Figure 5:
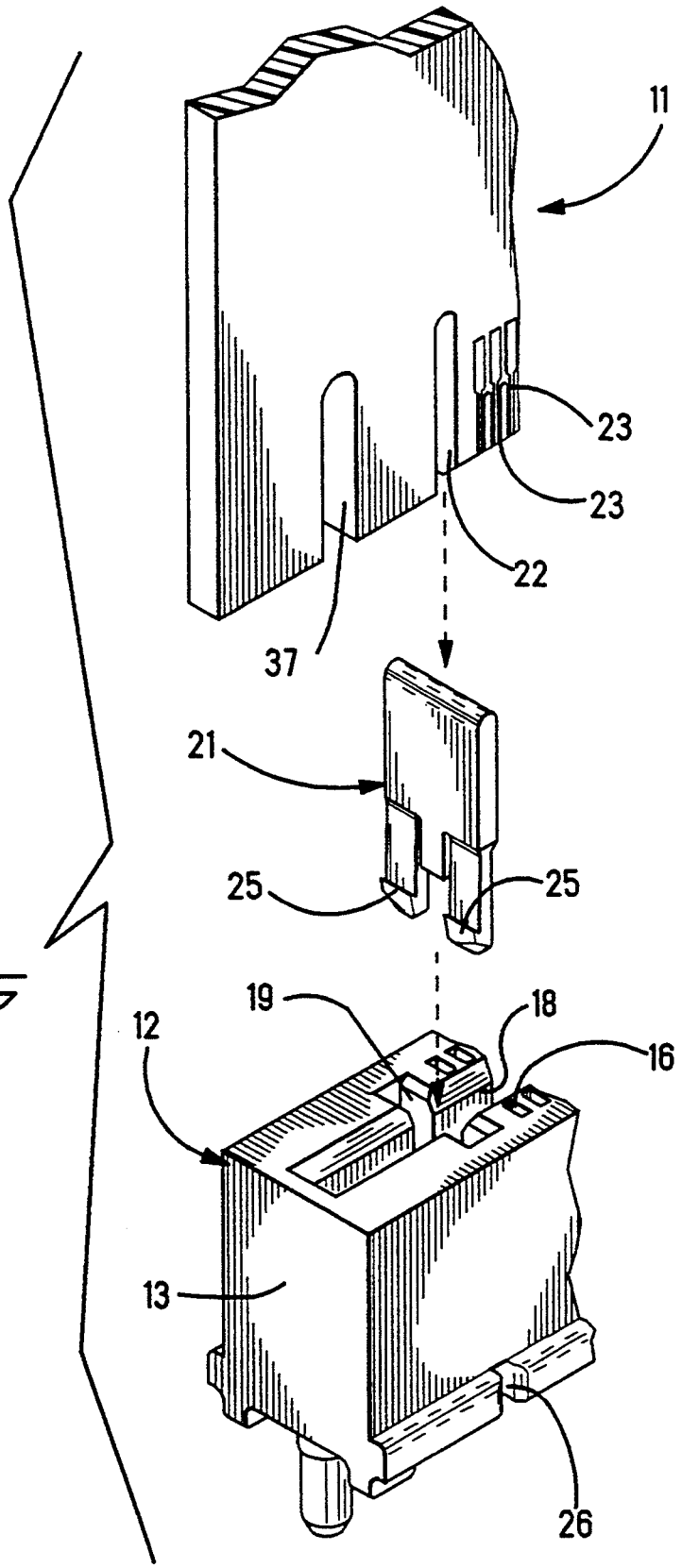
FIG. 5 is an exploded perspective view showing the removable key with latches, the removable key being disposed in the key opening in the connector and the key slot in the circuit board receiving the key.
Figure 8:
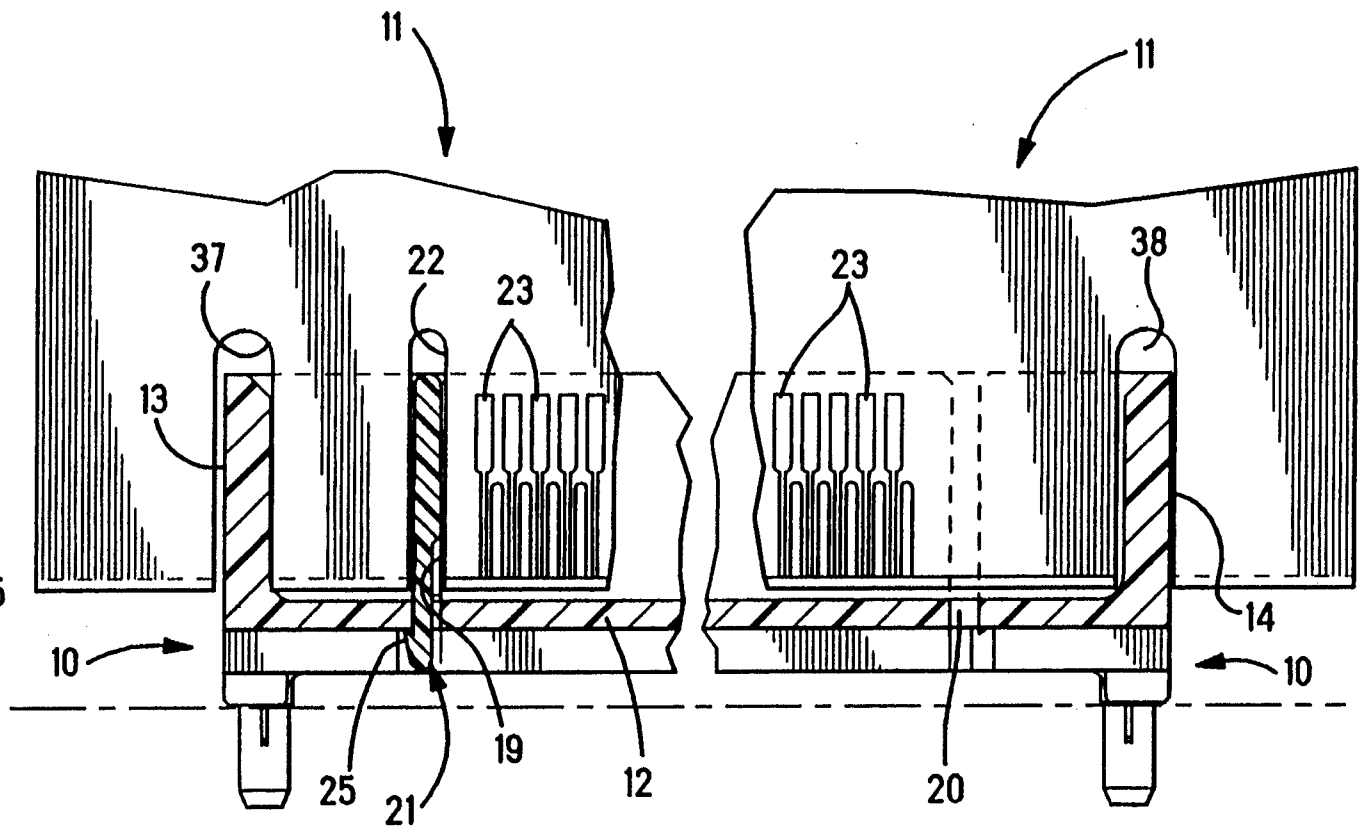
FIG. 8 is a cross section view of the connector of the present invention mated to the circuit board and showing the removable key engaged by the latches in the key opening.
Figure 6:
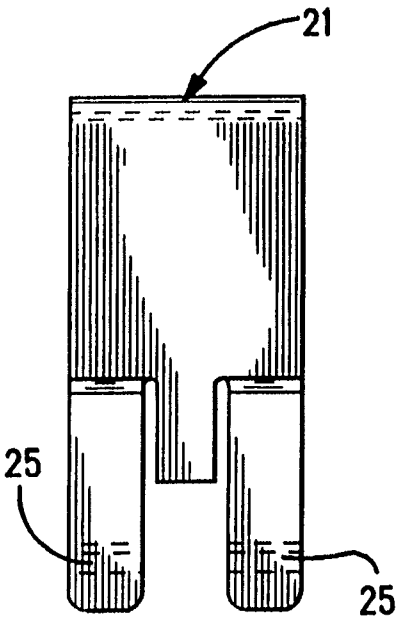
FIG. 6 is a front plan view of the removable key
Figure 7:
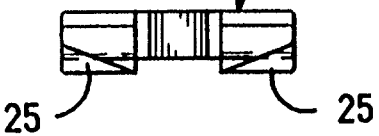
FIG. 7 is a bottom plan view of the removable key.
Figure 11:
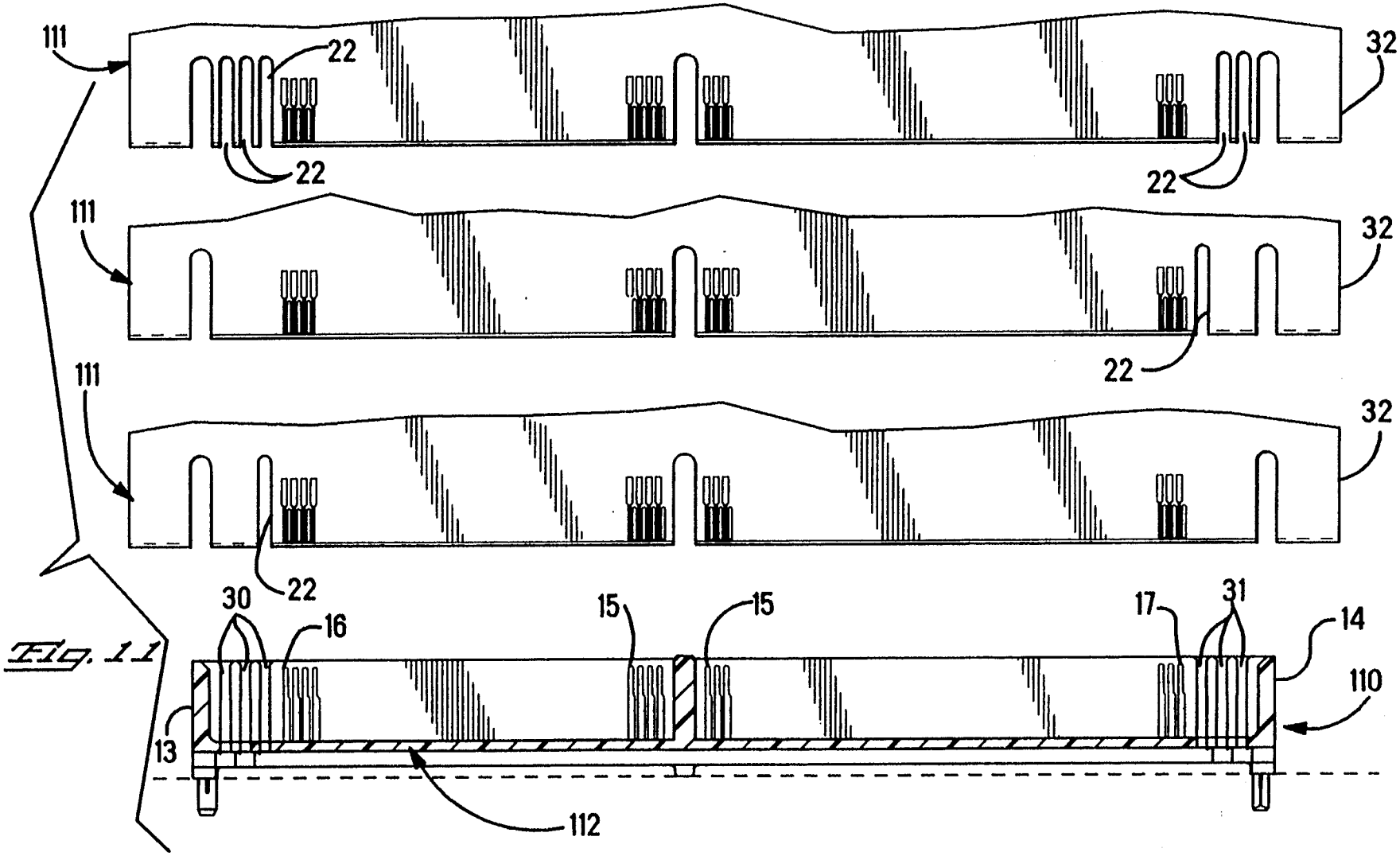
FIG. 11 is an exploded view showing the connector in cross section having a plurality of key openings and an array of circuit boards, any of which may be mated to the connector.

The housing 112 of the connector 110 may further have a first plurality of key positions 30 formed between the first end wall 13 and the initial contact 16 and a second plurality of key positions 31 formed between the second end wall 14 and the terminal contact 17 as shown in FIG. 5, 10 and 11. A corresponding array 32 of circuit boards 111 is provided, each having at least one key slot 22 to align and cooperate with a respective key positions 30, 31. In this manner, a connector 110 may be adapted to receive a selected circuit board 111 from an array 32 of circuit boards to the exclusion of all other circuit boards. By the use of two or more keys 21, it is possible to select an even more specific connector/-circuit board interface.

The housing 112 of the connector 110 may have one or more key positions 30, 31 between the contacts 16, 17 and the end walls 13, 14, wherein the key position is at a specific distance from the respective end wall 13, 14. The distance is variable and determined by the user. A predetermined distance (i.e., 1 mm, 2 mm, etc.) may be selected. The circuit board 111 has a key slot 22 formed at a corresponding relative predetermined distance such that the key slot 22 cooperates with and receives the key 21, 21' which is disposed in the key position 31. In this manner, the present invention provides the ability to have a connector 110 which is extremely specific and which can be mated with a cooperating circuit board 111 and only with the cooperating circuit board 111.

The present invention discloses a connector 10 which does not interfere with the contacts and permits a maximum number of contacts. The key permits and facilitates alignment of the connector with the circuit board. Due to the possible disposition of the key positions in the connector, a single key can be used to mate the connector to a specific circuit board configuration having a cooperating key slot to receive the key. Alternately, more than one key position may be formed in the connector to be used to mate with more than one key slot in a specific circuit board. The present invention discloses both removable and irremovable keys.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A card edge connector for connection to a circuit board, the connector comprising a housing having a first end wall and an opposite second end wall, a row of separated contacts having an initial contact and a terminal contact, the initial contact spaced from the first end wall, the terminal contact spaced from the second end wall, a longitudinal slot formed in the housing, a first key position formed in the housing between the first end wall and the initial contact, a second key position formed in the housing between the second end wall and the terminal contact, at least one key disposed in at least one of the key positions in the housing, the circuit board being disposed perpendicularly to the connector and being removably received in the longitudinal slot in the housing, the circuit board having at least one key slot formed therein, wherein when the circuit board is received in the connector, the at least one key in the connector cooperates with and is received in the at least one key slot in the circuit board.

2. The connector of claim 1, wherein the at least one key is removable, being insertable in and removable from, the at least one key position to permit connection with a selected circuit board.

3. The connector of claim 2, further comprising an access slot formed on the housing adjacent to the key position, wherein a tool may be inserted into the access slot permitting removal of the key.

4. The connector of claim 2, further comprising latching means formed on the at least one key, wherein the key may be secured to housing.

5. The connector of claim 1, wherein the at least one key is irremovably formed in the at least one key position in the housing.

6. The connector of claim 1, further comprising a first key disposed in the first key position and a second key disposed in the second key position, the circuit board having two key slots, wherein when the circuit board is received in the connector, both keys cooperate with and are received in the respective key slots in the circuit board.

7. The connector of claim 1, further comprising a first plurality of key positions formed in the housing between the first end wall and the initial contact and a second plurality of key positions formed between the second end wall and the terminal contact, an array of circuit boards, each circuit board having a key slot to align with and cooperate with at least one of the plurality of key positions in the connector such that a desired circuit board of the array may be selected to be received in the connector.

* * * * *